US012215561B1

(12) United States Patent
Rogozinski et al.

(10) Patent No.: US 12,215,561 B1
(45) Date of Patent: Feb. 4, 2025

(54) HOSE LIFT AND CONNECTION ASSEMBLY AND METHOD OF USE WITH A TOP DRIVE CEMENT HEAD

(71) Applicant: Citadel Casing Solutions, LLC, Houston, TX (US)

(72) Inventors: Nicolas Rogozinski, Evergreen, CO (US); Henry E. Rogers, Owasso, OK (US)

( * ) Notice: Subject to any disclaimer, the term of this patent is extended or adjusted under 35 U.S.C. 154(b) by 0 days.

(21) Appl. No.: 18/791,229

(22) Filed: Jul. 31, 2024

(51) Int. Cl.
*E21B 31/03* (2006.01)
*E21B 33/05* (2006.01)

(52) U.S. Cl.
CPC ..... *E21B 33/05* (2013.01)

(58) Field of Classification Search
CPC ..... E21B 33/05; E21B 33/04; E21B 33/03
USPC ..... 166/70
See application file for complete search history.

(56) References Cited

U.S. PATENT DOCUMENTS 8,381,808 B2 2/2013 Rogers et al.
8,695,715 B2 4/2014 Rogers et al.
9,850,739 B2 * 12/2017 Ferguson ..... E21B 33/14
10,041,310 B2 8/2018 Robichaux et al.
10,221,647 B2 3/2019 Rogozinski et al.
10,612,338 B2 4/2020 Rogers et al.
2011/0048710 A1 * 3/2011 Robichaux ..... E21B 17/05 166/70
2012/0133122 A1 * 5/2012 Hovik ..... F16L 37/1205 285/27
2013/0284457 A1 * 10/2013 Laurel ..... E21B 17/0465 166/380
2015/0159457 A1 * 6/2015 Hebert ..... E21B 19/22 166/85.1
2016/0145953 A1 * 5/2016 Martens ..... E21B 21/02 166/379
2017/0298700 A1 * 10/2017 Robichaux ..... E21B 19/008

* cited by examiner

*Primary Examiner* — Taras P Bemko
(74) *Attorney, Agent, or Firm* — Avek IP, LLC

(57) ABSTRACT

A hose lift and connection assembly for use with a top drive head includes a stinger housing and a stinger. The stinger housing is to connect to the top drive head and includes a main manifold connected to a side port assembly to direct fluid to the top drive head, a tubular body having flow ports to direct fluid flow into the side port assembly, and a latch mechanism having an open configuration to receive a stinger and a close configuration to retain the stinger. The stinger connects to pumping equipment and is to engage with the stinger housing such that a hydraulic flow path is actuated from the pumping equipment to the top drive head.

18 Claims, 11 Drawing Sheets

HOSE LIFT AND CONNECTION ASSEMBLY AND METHOD OF USE WITH A TOP DRIVE CEMENT HEAD

FIELD OF THE DISCLOSURE

The disclosure relates generally to tools for use in wellbore operations. More specifically, the disclosure relates to a hose lift and connection assembly and method of use with a top drive cement head.

BRIEF SUMMARY OF INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

In some aspects, the present invention relates to a hose lift and connection assembly for use with a top drive head, the assembly comprising a stinger housing and a stinger. The housing has a housing bore that extends from a top end of the stinger housing to a bottom end of the stinger housing, the stinger housing is configured to connect to the top drive head. The stinger housing further includes a main manifold connected to a side port assembly, the side port assembly having a flow path that connects to the housing bore and directs fluid flow to the top drive head, an upper shoulder extending inward into the housing bore near the top end, one or more tubular bodies forming at least part of the housing bore, the one or more tubular bodies having one or more flow ports to direct fluid flow into the side port assembly, and a latch mechanism having an open configuration and a closed configuration, wherein in the open configuration, the stinger housing is configured to receive a stinger, and wherein in the closed configuration, the stinger housing retains the stinger. The stinger is configured to connect to pumping equipment and is further configured to engage with the stinger housing such that a hydraulic flow path is created from the pumping equipment to the top drive head. The stinger includes a stinger adapter having one or more outer flow ports, a flow piston mounted internally within the stinger adapter, the flow piston having one or more internal flow ports, and a combination of one or more finger pistons and a plug piston coupled to the flow piston, the one or more finger pistons extending radially from a center line of the stinger. The stinger is configured to extend through the stinger housing from the bottom end to the top end. As the stinger is moved through the stinger housing, the finger piston is configured to engage with the upper shoulder such that force is applied through the finger piston to the plug piston and further to the flow piston. Force applied to the flow piston causes the flow piston to shift such that the one or more internal flow ports align with the one or more outer flow ports of the stinger adapter. After the latch mechanism closes to retain the stinger within the stinger housing, the stinger is positioned such that the hydraulic flow path is created from the pumping equipment to the top drive head.

In other aspects, the present invention relates to a method of connecting a fluid pumping hose to a top drive head. First, a stinger housing is provided having a housing bore that extends from a top end of the stinger housing to a bottom end of the stinger housing, the stinger housing further having a main manifold connected to a side port assembly, an upper shoulder extending inward into the housing bore near the top end, one or more tubular bodies forming at least part of the housing bore, the one or more tubular bodies having one or more flow ports to direct fluid flow into the side port assembly, and a latch mechanism having an open configuration and a closed configuration. A stinger is provided having a stinger adapter having one or more outer flow ports, a flow piston mounted internally within the stinger adapter, the flow piston having one or more internal flow ports, and a combination of one or more finger pistons and a plug piston coupled to the flow piston, the one or more finger pistons extending radially from a center line of the stinger. The stinger housing is mounted to the top drive head such that the side port assembly directs fluid flow to the top drive head, the stinger housing mounted with the latch in the open configuration. The stinger is connected to pumping equipment. Finally, the stinger is moved through the housing bore of the stinger housing until the one or more finger pistons engage with the upper shoulder such that force is applied through the finger piston to the plug piston and further to the flow piston. Force applied to the flow piston causes the flow piston to shift such that the one or more internal flow ports align with the one or more outer flow ports of the stinger adapter. After the latch mechanism closes to retain the stinger within the stinger housing, the stinger is positioned such that a hydraulic flow path is created from the pumping equipment to the top drive head.

BRIEF DESCRIPTION OF THE SEVERAL VIEWS OF THE DRAWINGS

Illustrative embodiments of the present disclosure are described in detail below with reference to the attached drawing figures.

LIST OF REFERENCE NUMBERS

Figure 11:
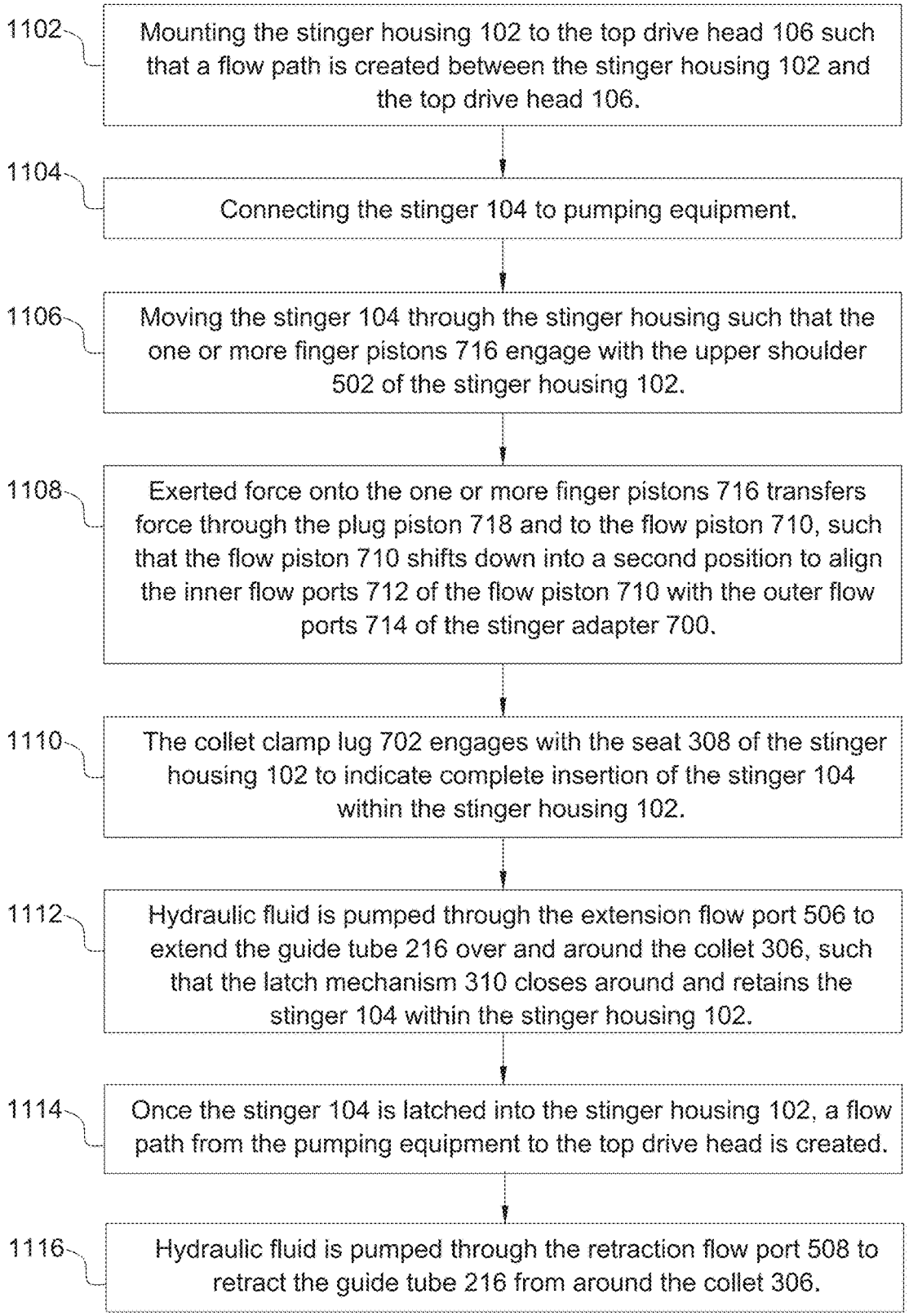
FIG. 11 is a flowchart of a method of connecting fluid pumping equipment to a top drive head using the hose lift and connection assembly of the present invention.

100-Hose Lift and Connection Assembly
102-Stinger Housing
104-Stinger
106-Drive Head
200-Swivel Assembly
202-Connection Port
204-Hydraulically Operated Plug Valve
206-Top End of Stinger
208-Bottom End of Stinger
210-Connection Nut
212-Side Port Assembly
214-Main Manifold
216-Guide Tube
218-End Cap
220-Bottom Shoulder
222-Leading Tube
224-Ring
226-Piston
228-Garter Spring
300-Top End of Stinger Housing
302-Bottom End of Stinger Housing
304-Upper Body
306-Latch Collet
308-Seat
310-Latch Mechanism
500-Flow Port(s)
502-Upper Shoulder
503-Upper Opening
504-Housing Bore
506-Extension Flow Port
508-Retraction Flow Port
700-Stinger Adapter
701-Hose Connector
702-Collet Clamp Lug
703-Internal Shoulder
704-Innter Sleeve
705-Outer Shoulder
706-Spring
708-Spring Housing
710-Flow Piston
712-Inner Flow Ports
714-Outer Flow Ports
716-Finger Piston(s)
718-Plug Piston
720-Top Cap
722-Top End Assembly
724-Lift Bolt
725-Cable
726-Central Bore of Stinger
1000-Side Bore
1002-Projections
1102-1116-Steps of Flowchart of FIG. 11

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of the equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Well drilling operations are well known in the art, particularly in the oil and gas industry. During operations, fluid pumping operations are completed, wherein a fluid supply is connected to a work string for the intended operation. These operations conventionally require human intervention, which can be a safety hazard and inefficient.

The present invention provides for a hose lift and connection assembly, as well as a method of use, for connecting a fluid pumping hose from floor rig pumping equipment to a rotating top drive cement head without the need for human intervention at elevated heights. Specifically, the present invention provides for a stinger housing and stinger as part of the hose lift and connection assembly, wherein, when the stinger is engaged with the stinger housing, a flow path from the pumping hose to the top drive cement head is created. Once the connection is made, fluid pumping operations can be performed via the fluid pumping hose, through the stinger and stinger housing and through the rotating top drive head and downhole via a work string tubular supplied by the rig. Those skilled in the art will appreciate that eliminating the need for human intervention at elevated heights provides for safer and quicker operations for personnel on location during the well operations.

Figure 1:
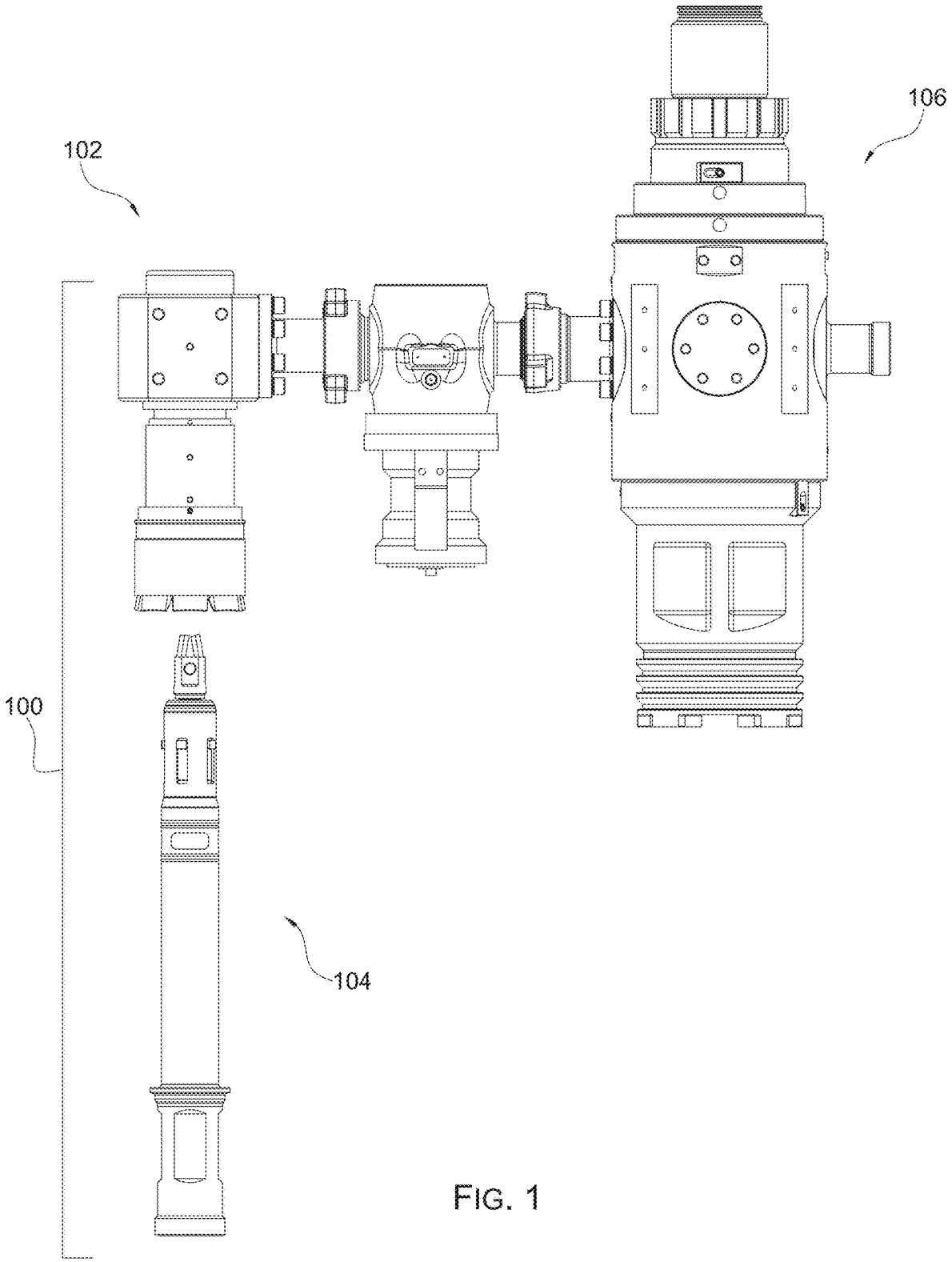
FIG. 1 is a front view showing a system including a portion of a top drive cement head and a hose lift and connection assembly in accordance with the present invention.

As shown in FIG. 1, the present invention is for a hose lift and connection assembly 100 for connecting pumping equipment to a top drive head 106. The hose lift and connection assembly 100 is made up of a stinger housing 102 and stinger 104, the interaction of which creates the flow path from a fluid pumping hose (not shown) to the drive head 106. Those skilled in the art will appreciate that only a portion of the top drive head 106 is shown.

Figure 2:
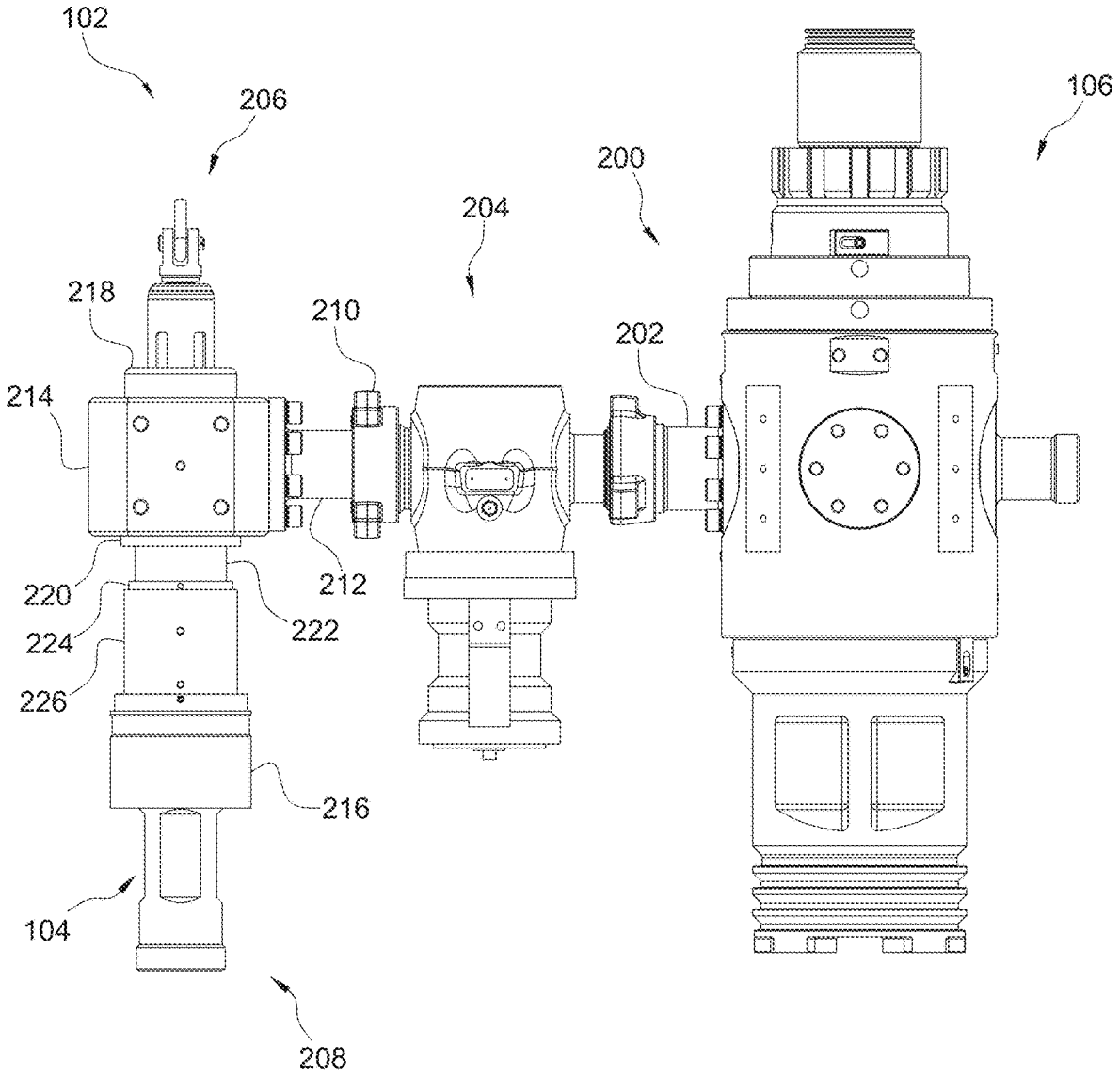
FIG. 2 is a front view showing the system of FIG. 1 with a stinger housing and a stinger as part of the hose lift and connection assembly, the stinger housing connected to the top drive cement head via a swivel assembly in accordance with the present invention.
Figure 3:
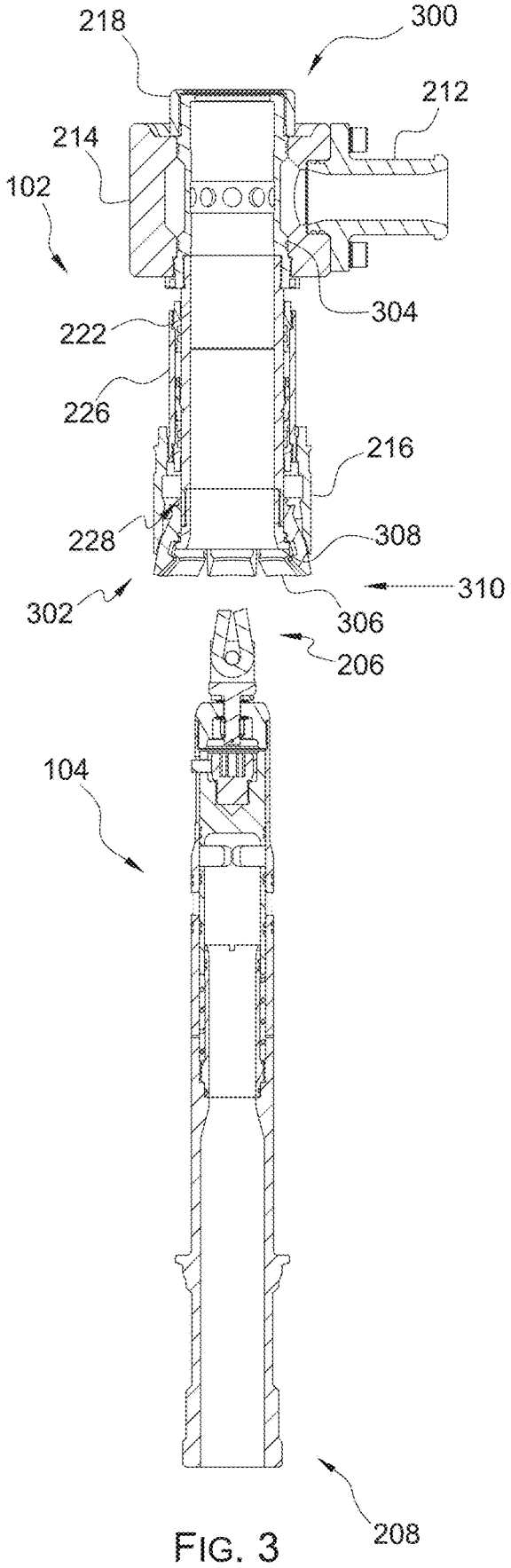
FIG. 3 is a front, cross-sectional view of the stinger housing and the stinger in accordance with the present invention.
Figure 4:
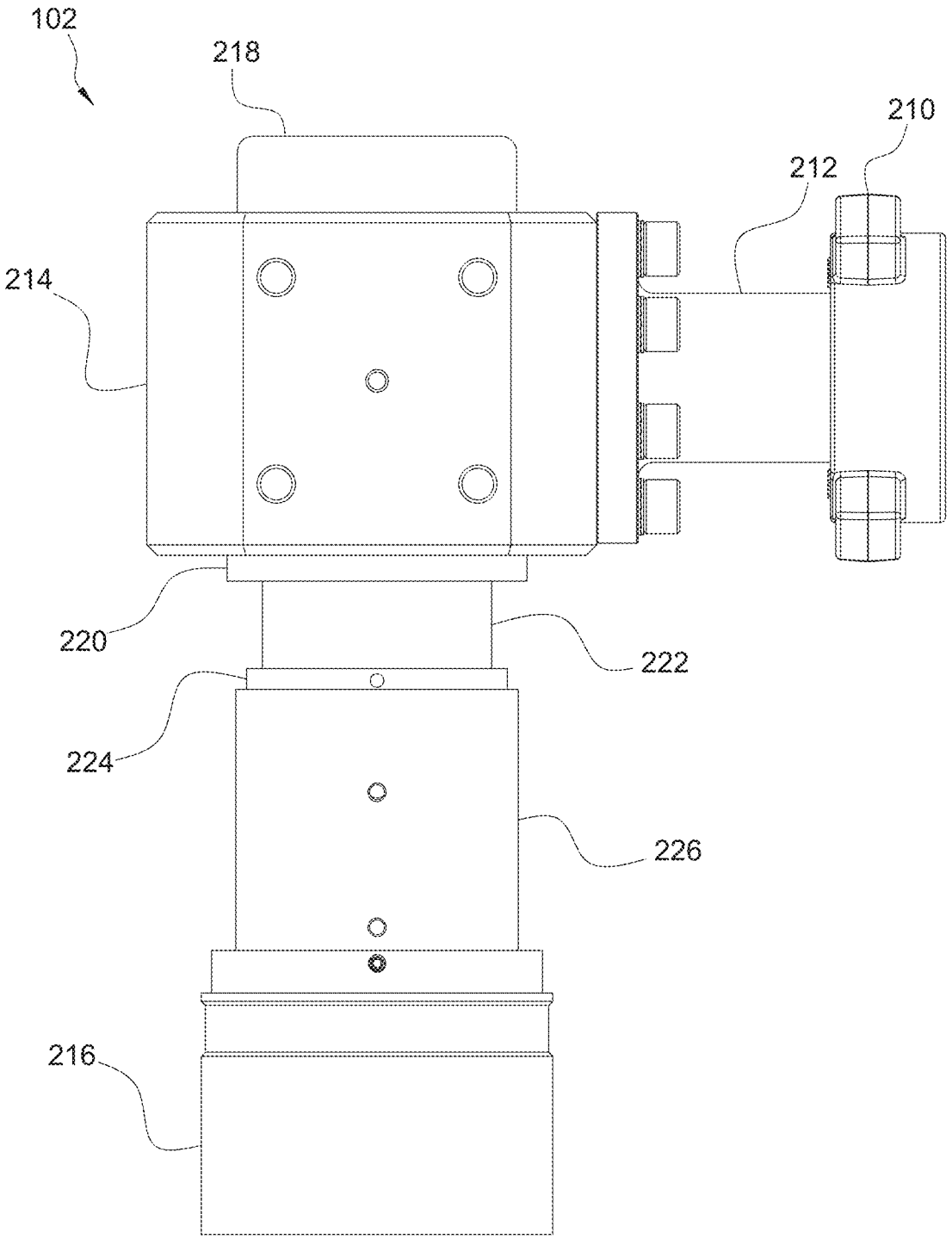
FIG. 4 is a front view of the stinger housing in a closed latch configuration.
Figure 5:
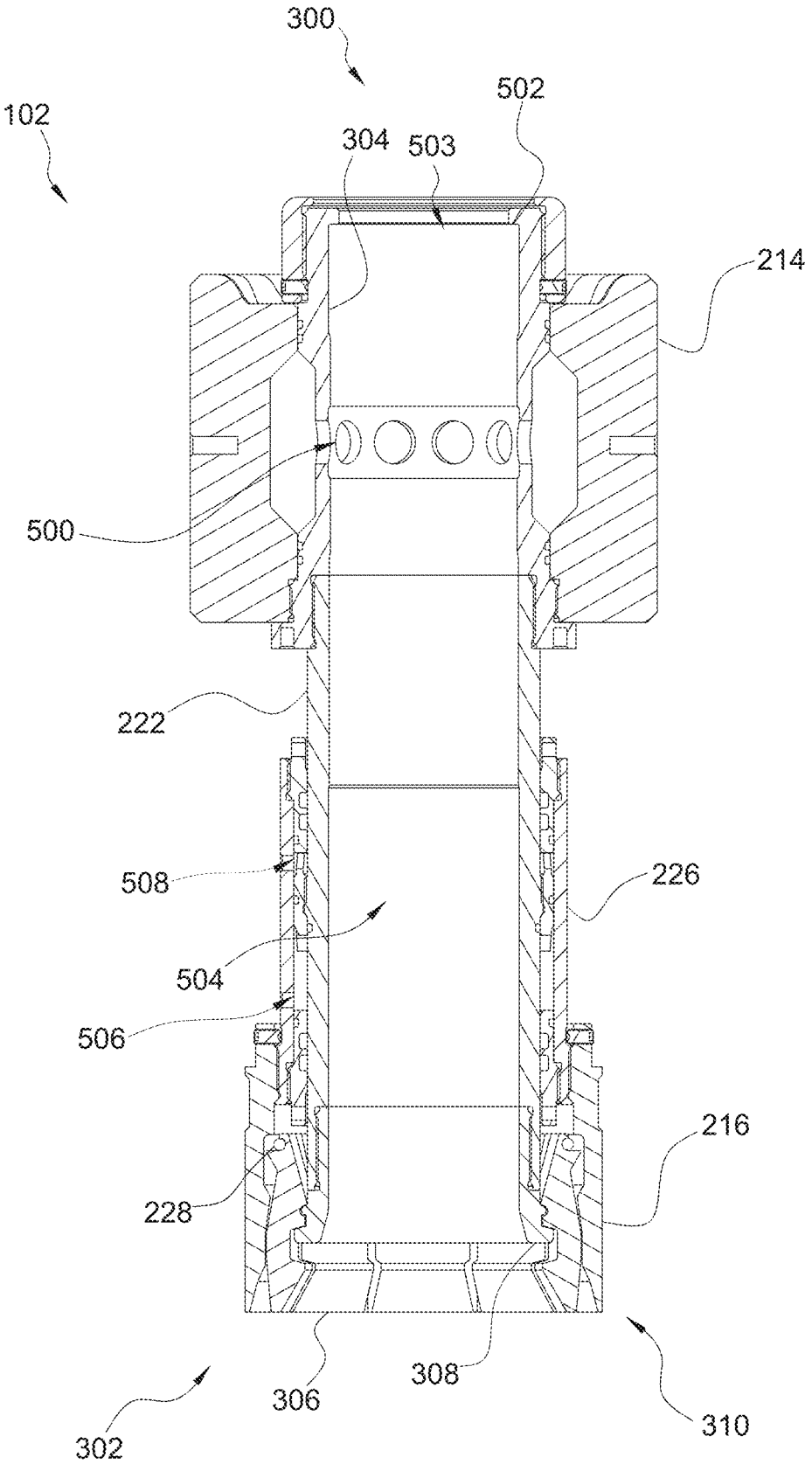
FIG. 5 is a front, cross-sectional view of the stinger housing in the closed latch configuration.

FIG. 2 demonstrates the stinger housing 102 connected to a hydraulically operated plug valve 204 of the drive head 106 and further to a swivel assembly 200. A connection port 202 extends from the swivel assembly 200 to the hydraulically operated plug valve 204. The stinger housing 102 is connected via any means appropriate in the art, such as a connection nut 210 and a side port assembly 212. Those skilled in the art will appreciate that the drive head 106 can vary in embodiments and applications without departing from the present invention. As shown, to create a flow path from the pumping equipment to the drive head 106, the stinger 104 will extend through the stinger housing 102 such that the top end 206 of the stinger extends from the top of the stinger housing 102 and the bottom end 208 protrudes from the bottom of the stinger housing 102. The bottom end 208 will connect to a pumping hose (not shown). In FIG. 3, the stinger 104 is shown prior to connection with the stinger housing 102. Specifically, the stinger housing 102 is shown in an open configuration as described herein.

As shown in FIGS. 2 through 5, the stinger housing includes a main manifold 214 which connects to the side port assembly 212. A guide tube 216 is coupled to a piston 226 which is further coupled to a leading tube 222 such as via one or more rings 224. It should be appreciated that the piston 226 is configured to move up and down relative to the leading tube 222, the piston 226 being coupled to the guide tube 216 such that the guide tube moves therewith. One or more tubular bodies create a housing bore 504 that extends from the top end of the stinger housing 102 to the bottom end of the stinger housing 102. An upper body 304 also forms part of the bore 504 and includes one or more flow ports 500 that align with the side port assembly 212 to direct fluid flow thereto. A bottom shoulder 220 of the upper body 304 aids in securing the main manifold 214 and the upper body 304 together. Those skilled in the art will appreciate that the leading tube 222 and the upper body 304 may be integral as a single unit or may be composed of multiple entities.

Figure 6:
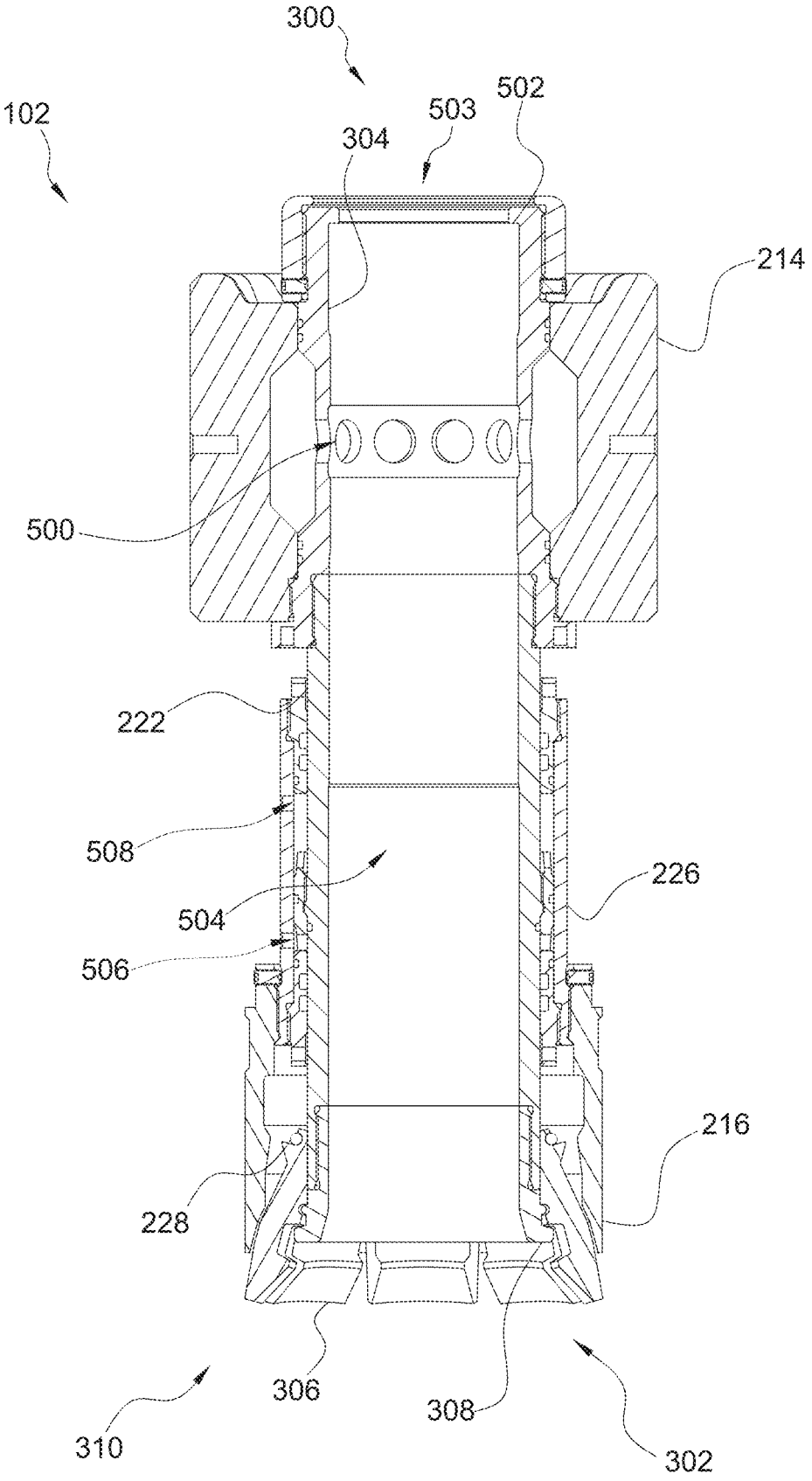
FIG. 6 is a front, cross-sectional view of the stinger housing in an open latch configuration.
Figure 10:
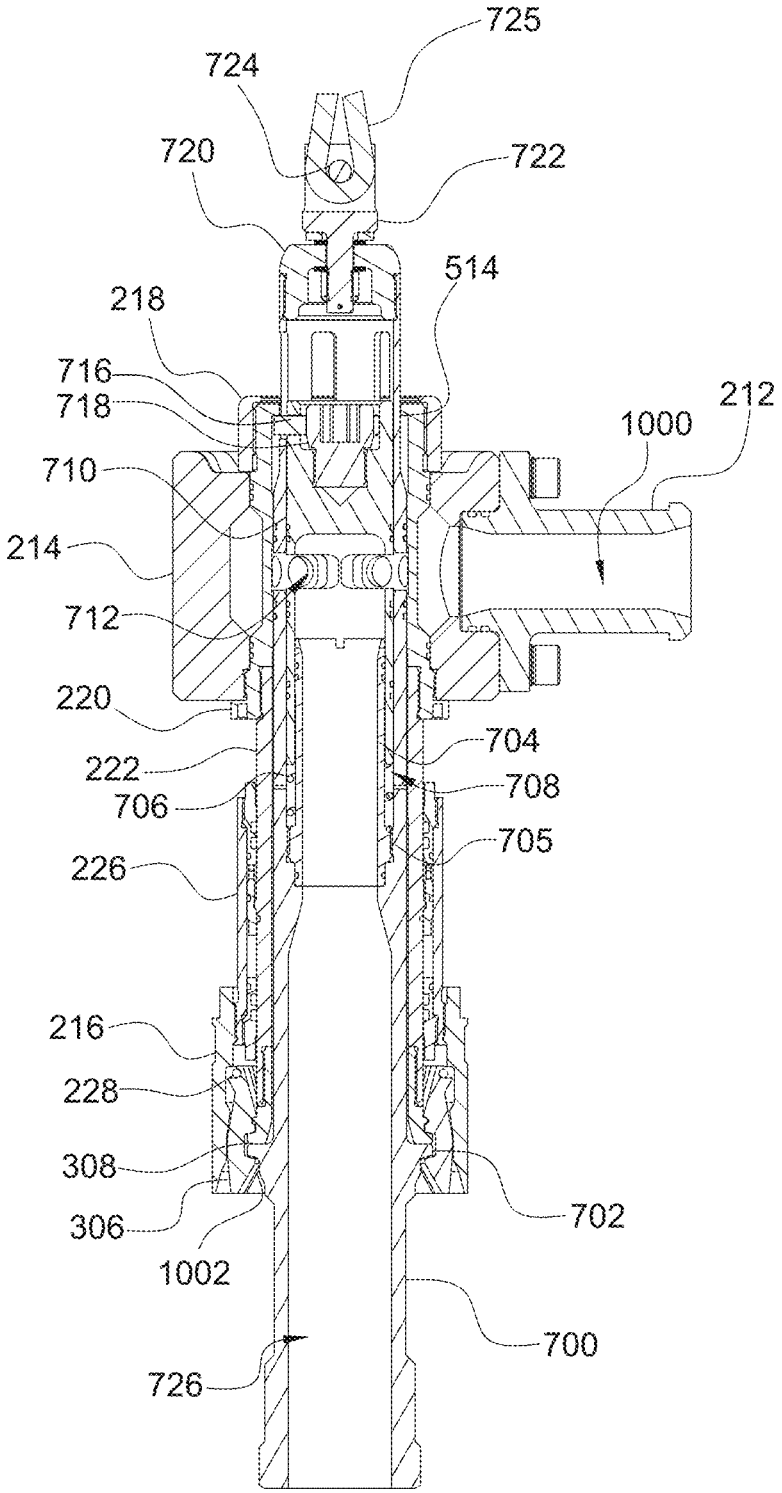
FIG. 10 is a front, cross-sectional view showing the hose lift and connection assembly with the stinger inserted into the stinger housing.

As part of the stinger housing 102, a latch mechanism 310 is used to latch onto the stinger 104 once the stinger is moved into the housing 102. Specifically, the latch mechanism 310 includes the guide tube 216 as well as a latch collet 306. As shown in FIG. 6, before the stinger 104 moves into the stinger housing 102, the latch collet 306 is in an open position and the guide tube 216 is in a retracted position. Specifically, the guide tube 216 is retracted away from the lower end of the latch collet 306 such that the latch collet 306 is flared outward as shown. The stinger 104 travels through the housing 102 until a collet clamp lug 702 abuts the seat 308, indicating that insertion is complete. Once insertion is completed, hydraulic fluid is pumped through an extension flow port 506 causing the piston 226 to move downward, along with the guide tube 216 such that the guide tube 216 forces the latch collet 306 into a locking engagement around the collet clamp lug 702, as shown in FIG. 10. The latch mechanism 310 remains latched around the collet clamp lug 702 until hydraulic fluid is pumped through a retraction flow port 508. Fluid through the retraction flow port 508 retracts the piston 226, along with guide tube 216, such that the latch collet 306 opens back up into the flared configuration, as shown in FIG. 6. The stinger 104 is then released from the stinger housing 102. The latch mechanism is discussed in more detail herein and shown best in FIG. 10.

The stinger housing 102 further includes an upper shoulder 502 near the top end 300 of the stinger housing 102. The upper shoulder 502 extends inward, such that an upper opening 503 is of a lesser diameter than the housing bore 504. As discussed herein, the upper shoulder 502 provides a stop to engage with the stinger 104 as the stinger 104 passes therethrough, such that force is applied through the stinger 104 to create the flow path from pumping equipment to the drive head 106.

Figure 7:
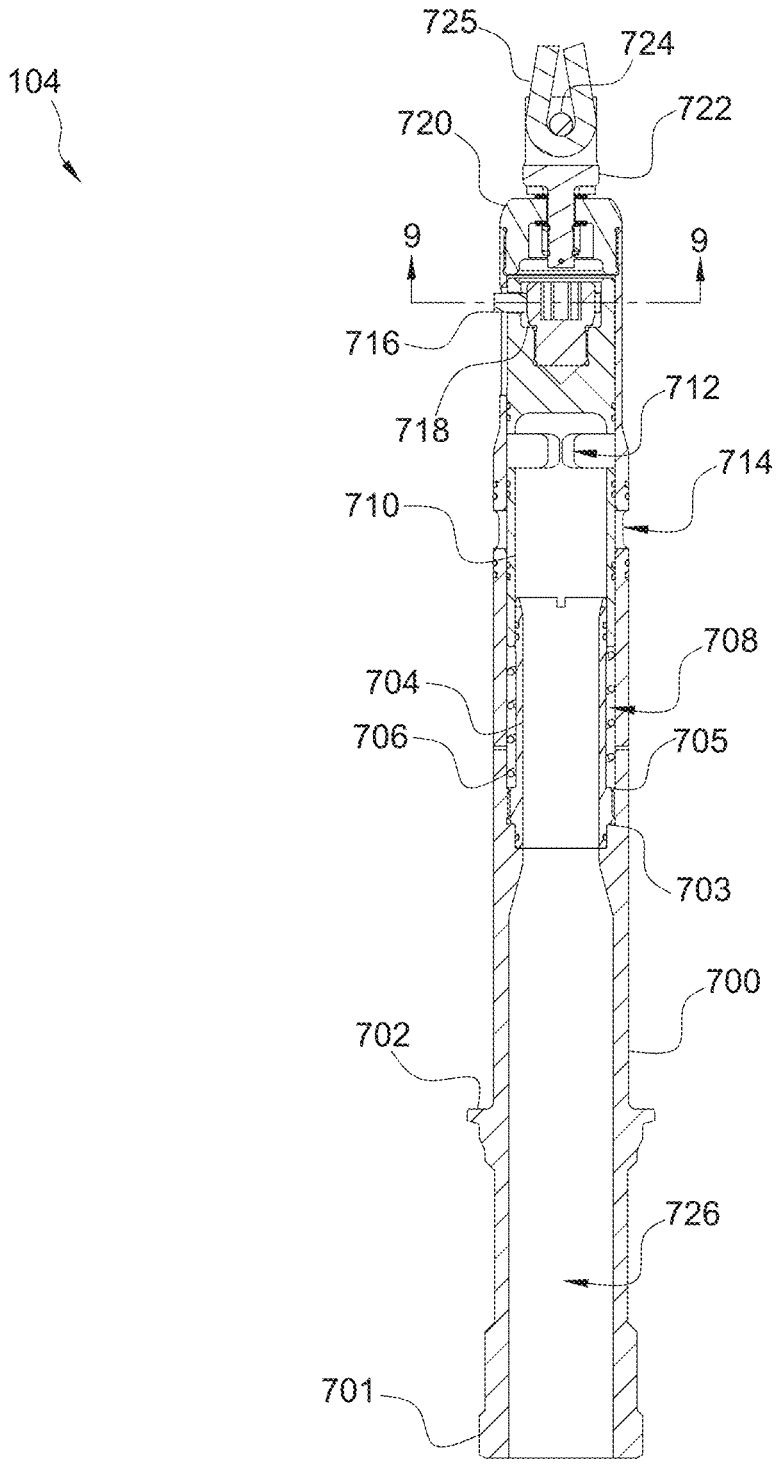
FIG. 7 is a front, cross-sectional view of the stinger in a closed configuration.
Figure 8:
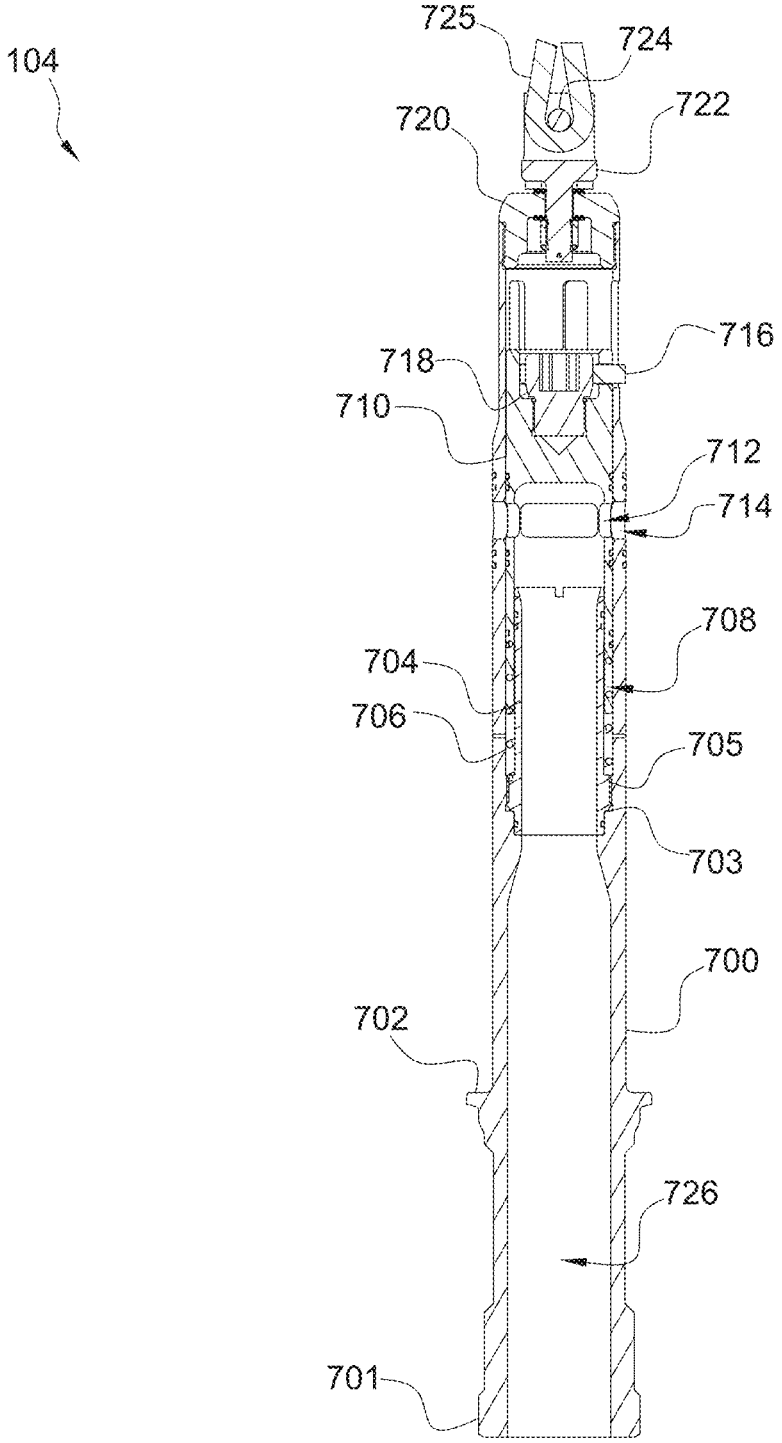
FIG. 8 is a front, cross-sectional view of the stinger in an open configuration.

The stinger 104 is shown best in FIGS. 7 and 8. FIG. 7 depicts the stinger 104 in a closed position, while FIG. 8 depicts the stinger 104 in the open position. The stinger 104 includes a stinger adapter 700 as the main structural component of the stinger 104. The adapter 700 may be one single body or may be composed of a plurality of bodies secured together. The adapter 700 supports a hose connector 701 for engaging with a pump hose (not shown). The hose connector 701, in embodiments, is a threaded connection, however it is contemplated that additional styles of connectors may be used. The adapter 700 also includes the collet clamp lug 702 that extends outward from the adapter 700. The collet clamp lug 702 is configured to abut the seat 308 of the stinger housing 102 to indicate that the stinger 104 is fully inserted into the stinger housing 104 as described above.

The stinger adapter 700 includes an internal shoulder 703 that extends inward to support an inner sleeve 704. Specifically, the inner sleeve 704 has an outer shoulder 705 to support a spring 706 on the inner shoulder 703 of the adapter 700. The spring 706 is positioned within a spring housing 708, the spring housing 708 being an open area between an outer surface of the inner sleeve 704 and an inner surface of the adapter 700.

The stinger 104 further includes a flow piston 710 having one or more inner flow ports 712. As shown in FIG. 7, when in the closed position, the inner flow ports 712 are misaligned with outer flow ports 714, however, once the stinger 104 is in the open position (FIG. 8), the inner flow ports 712 align with the outer flow ports 714 such that flow from a central bore 726 of the stinger through the flow ports 712, 714 is achieved. A mechanism for aligning the inner flow ports 712 and outer flow ports 714 uses one or more finger pistons 716 coupled to a plug piston 718. The plug piston 718 is further coupled to the flow piston 710. It is contemplated that the flow piston 710 and plug piston 718 may be a unified body or alternatively may be multiple bodies coupled together though any appropriate means known in the art.

The stinger 104 further includes a top cap 720 coupled to a top end assembly 722, which can vary, but regardless provides a means to couple the stinger 104 to a mechanism to exert force thereto. For example, a lift bolt 724 can be used with a cable 725 to provide a lifting force on the stinger 104 via a lift apparatus (not shown).

Figure 9:
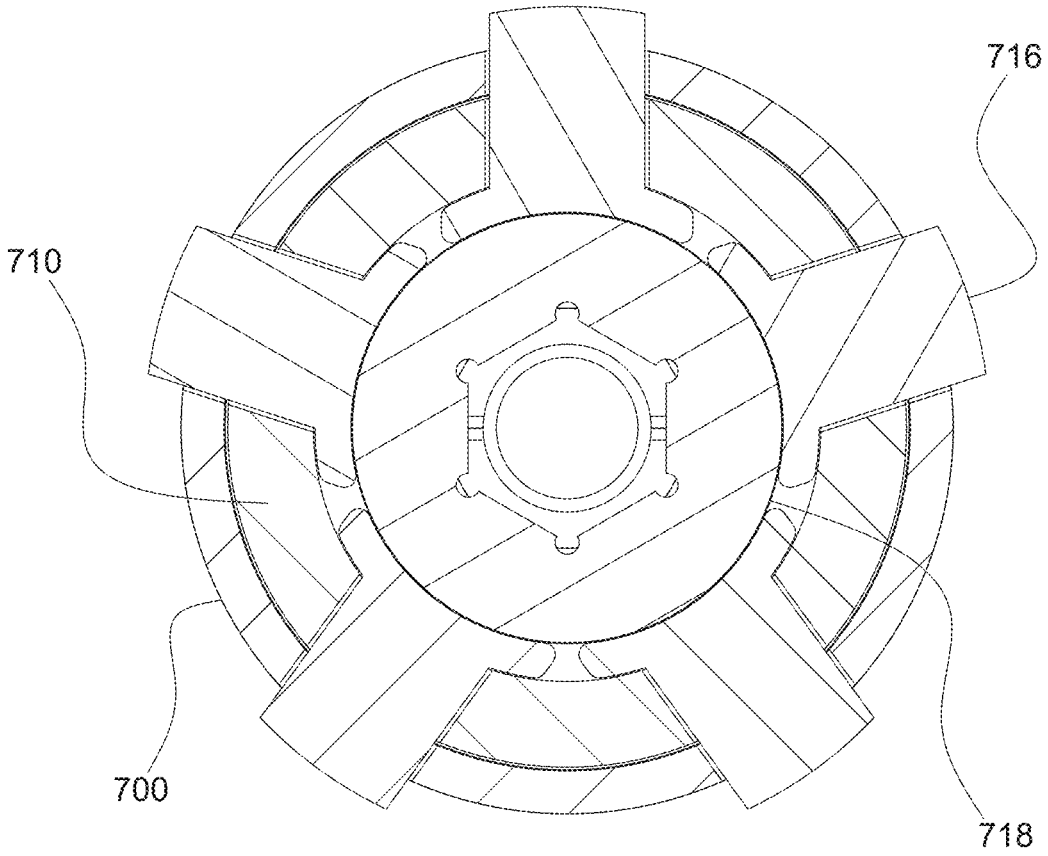
FIG. 9 is a cross-sectional view taken from line 9-9 in FIG. 7.

In FIG. 9, a cross sectional view taken at line 9-9 is shown demonstrating the one or more finger pistons 716 extending radially from a center line of the stinger 104 and from the plug piston 718. The one or more finger pistons 716 extend outward past an outer surface of the stinger adapter 700 at the location of the finger pistons 716. Although five finger pistons 716 are shown, those skilled in the art will appreciate that modifications may be made thereto in size and number.

Turning now to FIG. 10, a cross-sectional view demonstrates the stinger 104 coupled to the stinger housing 102. As shown, the one or more finger pistons 716 will engage with the upper shoulder 502 as upward force is applied to the stinger 104. The force is applied through the finger piston(s) 716 to the plug piston 718 and then to the flow piston 710. This force ultimately pushes the flow piston 710 downward against the spring 706 causing the spring 706 to compress. The downward movement of the flow piston 710 moves the inner flow ports 712 into alignment with the outer flow ports 714 thereby creating a flow path from pumping equipment (not shown), through the central bore of the stinger 726, through a side bore 1000, and to the drive head 106.

As also best shown in FIG. 10, as the stinger 104 travels through the stinger housing 102, the collet clamp lug 702 will eventually come into contact with the seat 308 of the housing 102, indicating that insertion of the stinger 104 is complete. In embodiments, a garter spring 228 extends around the latch collet 306. As discussed above, hydraulic pressure is used to move the piston 226 and guide tube 216 into the closed position, locking the stinger 104 within the stinger housing 102. The latch collet 306 is shaped such that projections 1002 wrap under the collet clamp lug 702 to ultimately latch the stinger 104 in position within the housing 102. Those skilled in the art will appreciate that alternative means of latching may be utilized without departing from the present invention. In order to unlatch, hydraulic pressure is again used to retract the piston 226 and guide tube 216 such that the latch collet 306 opens to release the stinger 104.

In FIG. 11, a flowchart depicts the method of use of the hose lift and connection assembly 100. At step 1102, the stinger housing 102 is mounted to the top drive head 106 via any connection mechanism appropriate in the art. The stinger housing 102 will remain attached thereto until needed. At step 1104, the stinger 104 is connected to pumping equipment, again via a means appropriate in the art. At step 1106, when the flow path between the pumping equipment and the drive head 106 is needed, the stinger 104 will be moved through the stinger housing 102 such that the one or more finger pistons 716 engage with the upper shoulder 502 of the stinger housing 102. At step 1108, the exerted force onto the finger piston(s) 716 transfers through the plug piston 718 to the flow piston 710 such that the flow piston 710 shifts down into a second position to align the inner flow ports 712 of the flow piston 710 with the outer flow ports 714 of the stinger adapter 700.

At step 1110, as the stinger 104 moves through the stinger housing 102, the collet clamp lug 702 will engage with the seat 308 to indicate complete insertion of the stinger 104 into the stinger housing 102. At step 1112, hydraulic fluid is pumped through the extension flow port 506 to extend the guide tube 216 over and around the latch collet 306, such that the latch mechanism 310 closes around the stinger 104 to retain the stinger 104 within the stinger housing 102. At step 1114, once the stinger 104 is latched into the stinger housing 102, a flow path from the pumping equipment to the top drive head is created. Finally, at step 1116, hydraulic fluid is pumped through the retraction flow port 508 to retract the guide tube 216 from around the latch collet 306, thereby releasing the stinger 104 from the stinger housing 102.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

The invention claimed is:

1. A hose lift and connection assembly for use with a top drive head, the assembly comprising:

a stinger housing having a housing bore that extends from a top end of the stinger housing to a bottom end of the stinger housing, the stinger housing is configured to connect to the top drive head, the stinger housing having:

a main manifold connected to a side port assembly to direct fluid flow to the top drive head;

an upper shoulder extending inward into the housing bore near the top end;

one or more tubular bodies forming at least part of the housing bore, the one or more tubular bodies having one or more flow ports to direct fluid flow into the side port assembly; and a latch mechanism having an open configuration and a closed configuration, wherein in the open configuration, the stinger housing is configured to receive a stinger, and wherein in the closed configuration, the stinger housing retains the stinger;

the stinger is configured to connect to pumping equipment and to engage with the stinger housing such that a hydraulic flow path is actuated from the pumping equipment to the top drive head, the stinger having:

a stinger adapter with one or more outer flow ports;

a flow piston mounted internally within the stinger adapter, the flow piston having one or more internal flow ports; and a combination of one or more finger pistons and a plug piston coupled to the flow piston, the one or more finger pistons extending radially from a center line of the stinger;

wherein the stinger is configured to extend through the stinger housing from the bottom end to the top end;

wherein as the stinger is moved through the stinger housing, the one or more finger pistons are configured to engage with the upper shoulder such that force is applied through the one or more finger pistons to the plug piston and further to the flow piston;

wherein force applied to the flow piston causes the flow piston to shift such that the one or more internal flow ports align with the one or more outer flow ports of the stinger adapter; and wherein after the latch mechanism closes to retain the stinger within the stinger housing, the stinger is positioned such that the hydraulic flow path is created from the pumping equipment to the top drive head.

2. The hose lift and connection assembly of claim 1, wherein the stinger housing further comprises a seat and the stinger further comprises a collet clamp lug extending outward from the stinger adapter, the collect clamp lug is configured to abut with the seat as the stinger is moved through the stinger housing.

3. The hose lift and connection assembly of claim 2, wherein the latch mechanism further comprises:

a guide tube; and a latch collet positioned substantially between the guide tube and the seat, the latch collet having an opening through which the stinger travels through;

wherein the latch collet is configured to actuate from an open position to a closed position after the collect clamp lug abuts with the seat, thereby latching the stinger within the stinger housing; and wherein the guide tube is extended around the latch collet to actuate the latch collet from the open position to the closed position.

4. The hose lift and connection assembly of claim 3, wherein pressure from hydraulic fluid is used to extend the guide tube around the latch collet.

5. The hose lift and connection assembly of claim 1, wherein the stinger further comprises:

an inner sleeve mounted within the stinger adapter; and a spring mounted within a spring housing, the spring housing formed at least partially between the inner sleeve and the adapter;

wherein as the one or more finger pistons engages with the upper shoulder and the flow piston is forced to shift, the flow piston compresses the spring within the spring housing.

6. The hose lift and connection assembly of claim 5, wherein the spring is compressed against an outer shoulder of the inner sleeve.

7. The hose lift and connection assembly of claim 1, wherein the stinger further comprises a top end assembly coupled to a top end of the stinger, the top end assembly having a lift bolt configured to engage with a cable, wherein the cable is configured to apply upward force to the stinger to move the stinger through the stinger housing.

8. The hose lift and connection assembly of claim 1, wherein the plug piston is positioned centrally within the stinger adapter and is directly coupled to the flow piston and the one or more finger pistons extend radially from the plug piston and to an outside of the stinger adapter.

9. A method of connecting a fluid pumping hose to a top drive head, the method comprising:

providing a stinger housing having a housing bore that extends from a top end of the stinger housing to a bottom end of the stinger housing, the stinger housing further having a main manifold connected to a side port assembly, an upper shoulder extending inward into the housing bore near the top end, one or more tubular bodies forming at least part of the housing bore, the one or more tubular bodies having one or more flow ports to direct fluid flow into the side port assembly, and a latch mechanism having an open configuration and a closed configuration;

providing a stinger having a stinger adapter with one or more outer flow ports, a flow piston mounted internally within the stinger adapter, the flow piston having one or more internal flow ports, and a combination of one or more finger pistons and a plug piston coupled to the flow piston, the one or more finger pistons extending radially from a center line of the stinger;

mounting the stinger housing to the top drive head such that the side port assembly directs fluid flow to the top drive head, the stinger housing mounted with the latch in the open configuration;

connecting the stinger to pumping equipment; and moving the stinger through the housing bore of the stinger housing until the one or more finger pistons engage with the upper shoulder such that force is applied through the finger piston to the plug piston and further to the flow piston;

wherein force applied to the flow piston causes the flow piston to shift such that the one or more internal flow ports align with the one or more outer flow ports of the stinger adapter; and wherein after the latch mechanism closes to retain the stinger within the stinger housing, the stinger is positioned such that a hydraulic flow path is actuated from the pumping equipment to the top drive head.

10. The method of claim 9, further comprising:

abutting a collet clamp lug as part of the stinger against a a seat as part of the stinger housing when the stinger is moved through the housing bore;

wherein, when the collet clamp lug is abutted against the seat, the stinger is fully inserted into the stinger housing.

11. The method of claim 10, wherein the latch mechanism further comprises a guide tube and a latch collet positioned substantially between the guide tube and the seat, the latch collet having an opening through which the stinger travels through.

12. The method of claim 11, further comprising:

actuating the latch collet from an open position to a closed position by using hydraulic pressure to extend the guide tube around the latch collet such that the latch collet closes around the collet clamp lug, thereby latching the stinger within the stinger housing.

13. The method of claim 12, further comprising using hydraulic pressure to retract the guide tube away from the latch collet to release the stinger from the stinger housing.

14. The method of claim 9, wherein the stinger further comprises an inner sleeve mounted within the stinger adapter and a spring mounted within a spring housing, the spring housing formed at least partially between the inner sleeve and the adapter.

15. The method of claim 14, further comprising compressing the spring within the spring housing as the one or more finger pistons engage with the upper shoulder and the flow piston is forced to shift.

16. The method of claim 14, wherein the spring is compressed against an outer shoulder of the inner sleeve.

17. The method of claim 9, further comprising applying upward force to the stinger via a cable attached to a lift bolt as part of a top end assembly of the stinger, the upward force moving the stinger through the stinger housing.

18. The method of claim 9, wherein the plug piston is positioned centrally within the stinger adapter and is directly coupled to the flow piston and the one or more finger pistons extend radially from the plug piston and to an outside of the stinger adapter.

* * * * *